US006336501B1

(12) United States Patent
Ishikawa et al.

(10) Patent No.: US 6,336,501 B1
(45) Date of Patent: Jan. 8, 2002

(54) TUBE HAVING GROOVED INNER SURFACE AND ITS PRODUCTION METHOD

(75) Inventors: Mamoru Ishikawa; Kiyonori Ozeki; Nobuaki Hinago; Chikara Saeki, all of Hatano (JP)

(73) Assignee: Kabushiki Kaisha Kobe Seiko Sho (Kobe Steel, Ltd.), Kobe (JP)

( * ) Notice: Subject to any disclaimer, the term of this patent is extended or adjusted under 35 U.S.C. 154(b) by 0 days.

(21) Appl. No.: 09/468,302

(22) Filed: Dec. 21, 1999

(30) Foreign Application Priority Data

Dec. 25, 1998 (JP) ..... 10-371408
Jan. 29, 1999 (JP) ..... 11-023320

(51) Int. Cl.[7] ..... F28F 13/18

(52) U.S. Cl. ..... 165/133; 165/184; 165/177; 29/890.048

(58) Field of Search ..... 165/133, 177, 165/184, 181, 146; 29/890.048

(56) References Cited

U.S. PATENT DOCUMENTS 5,704,424 A * 1/1998 Kohno et al. ..... 165/184
5,791,405 A * 8/1998 Takiura et al. ..... 165/133
5,915,467 A 6/1999 Ishikawa et al.

FOREIGN PATENT DOCUMENTS

JP 406101986 * 4/1994 ..... 165/184

* cited by examiner

*Primary Examiner*—Christopher Atkinson
(74) *Attorney, Agent, or Firm*—Oblon, Spivak, McClelland, Maier & Neustadt, P.C.

(57) ABSTRACT

A tube having a grooved inner surface capable of achieving high condensing performance and high evaporating performance even in a region of a small flow rate of a refrigerant and preferable as a heat exchanger tube for a condenser as well as an evaporator and its fabrication method, wherein spiral groove fabricating zones 1 formed with spiral grooves are arranged at an inner surface of a metal or an alloy tube and intersecting groove fabricating zones 2 formed with intersecting groove groups intersected with pluralities of grooves are arranged at the inner surface of the metal or the alloy tube at regions different from each other, singles or pluralities of the spiral groove fabricating zones 1 and the intersecting groove fabricating zones 2 are alternately arranged in a tube circumferential direction of the metal or the alloy tube, when a fabrication width of the spiral groove fabricating zone 1 in the tube circumferential direction is designated by $W_1$ and a fabrication width of the intersecting groove fabricating zone 2 is designated by $W_2$, a ratio $W_1/W_2$ of $W_1$ to $W_2$ falls in a range of 1.1 through 3.0 and the ratio $W_1/W_2$ can also be made to fall in a range of 0.3 through 0.9.

4 Claims, 2 Drawing Sheets

TUBE HAVING GROOVED INNER SURFACE AND ITS PRODUCTION METHOD

BACKGROUND OF THE INVENTION

1. Field of the Invention

The present invention relates to a tube having a grooved inner surface preferable for a heat exchanger tube for use of a condenser as well as an evaporator which are used in a heat exchanger of an air conditioner or the like and its production method, particularly to a tube having a grooved inner surface achieving high condensing performance and evaporating performance even in a region in which a flow rate of a refrigerant is small and its production method.

2. Description of Related Art

There has conventionally been used a tube having a grooved inner surface having a plurality of spiral grooves at an inner surface of a tube as a heat exchanger tube to promote heat exchanging performance in a heat exchanger such as an air conditioner or the like.

According to heat exchange operation of an air conditioner or the like, there is utilized latent heat in evaporating a refrigerant liquid or condensing a refrigerant gas and in order to promote evaporating performance, there is needed a structure in which the refrigerant liquid is spread over a total of inside of a heat exchanger tube to thereby cause evaporation over an entire heat exchanger surface. In the meantime, in order to promote condensing performance, there is preferably used a structure in which the refrigerant liquid condensed on the heat exchanger surface can easily be removed and the liquid is easy to collect to one location such that the heat exchanger surface is not covered again by the removed liquid.

In recent times, in the case of an air conditioner or the like, in order to achieve energy conservation, there has been requested high heat exchanger performance (evaporating as well as condensing) and accordingly, it is indispensable to use a high heat exchanger performance tube even under a condition of small running load, that is, even in a region of a small flow rate of the refrigerant.

There have conventionally been proposed heat exchanger tubes shown below as tubes having grooved inner surfaces in which the inner surfaces of the tubes are fabricated to promote the heat exchanger performance.

According to a heat exchanger tube described in Japanese Unexamined Patent Publication No. 4-158193, there are installed a plurality of kinds of spiral groove groups. These spiral groove groups are formed such that at least one or more of factors in a pitch of groove in respect of a tube axis direction among adjacent spiral grooves, dimensions of the groove, the shape of the groove and a twist angle of the groove group in respect of the tube axis direction, differs.

Further, according to a heat exchanger tube described in Japanese Unexamined Patent Publication No. 8-121984, there are installed a plurality of continuous fins formed not to intersect with each other in the tube axis direction, discontinuous fins formed contiguous to the continuous fins in a discontinuous or sawtooth-like shape along a longitudinal direction such that the discontinuous fins do not intersect with the continuous fins and grooves formed between the discontinuous fins and the continuous fins.

Furthermore, according to a heat exchanger tube with grooves crossing an inner surface which is described in Japanese Unexamined Patent Publication No. 8-178574, in which grooves are formed at an inner surface of the tube to be inclined by 7° through 25° to the tube axis and sub grooves are installed in parallel with the tube axis or burrs are installed at three-dimensional projections left among the main grooves and the sub grooves to thereby conduct flow of the refrigerant in the direction of the sub groove.

Still further, according to a heat exchanger tube having a grooved inner surface described in Japanese Unexamined Patent Publication No. 10-206060, there are installed a first and a secondgroove group having the same groove pitch in a tube circumferential direction and different twist angles and twist directions in respect of the tube axis direction, there are arranged a plurality of sets of a first and a second groove fabricating region formed with the first and the second groove groups with different widths and there are arranged linear groove regions extending in the tube axis direction among the respective groove fabricating regions.

However, there are problems shown below in the above-described conventional heat exchanger tubes. First, according to the heat exchanger tube described in Japanese Unexamined Patent Publication No. 4-158193, although the flow of the refrigerant liquid is not hindered, the pressure loss cannot sufficiently be reduced in evaporation and accordingly, the evaporating performance is deteriorated and since discharge performance of the condensing refrigerant liquid is not sufficient in condensation, the performance of bringing the heat exchanger surface in contact with the refrigerant gas is lowered to thereby deteriorate the condensing performance. Further, when spiral groove groups having the same twist angle in respect of the tube axis direction are provided over the entire inner surface of the tube, the condensing refrigerant liquid is liable to spread over the entire heat exchanger surface in condensation, the heat exchanger surface is covered by the condensing refrigerant liquid and the condensing performance is deteriorated.

Further, according to the heat exchanger tube described in Japanese Unexamined Patent Publication No. 8-121984 and Japanese Unexamined Patent Publication No. 8-178574, the heat exchanger surface is designed with continuous grooves as a reference and accordingly, when the heat exchanger tube is used for a condenser, a swirl flow of the condensed refrigerant gas is liable to produce along the grooves. As a result, it is difficult to procure a dry heat exchanger surface necessary for condensation and accordingly, a deterioration in the condensing performance is resulted. Accordingly, there is a drawback in which the heat exchanger tube is not preferable in a heat pump type air conditioner requesting the evaporating performance and the condensing performance.

Further, according to the heat exchanger tube described in Japanese Unexamined Patent Publication No. 10-206060, there poses a problem in which the evaporating performance is deteriorated since a swirl flow of the refrigerant is hindered by the grooves in the reverse direction under a condition of a small flow rate of the refrigerant.

As mentioned above, in any of the conventional technologies, there are advantages and disadvantages and the performance excellent both in the evaporating and the condensing cannot be ensured.

SUMMARY OF THE INVENTION

The present invention have been carried out in view of such problems and it is an object of the present invention to provide a tube having a grooved inner surface capable of achieving high condensing performance and high evaporating performance even in a region of a small flow rate of a refrigerant and preferable as a heat exchanger tube for a condenser and an evaporator and its fabrication method.

According to an aspect of the present invention, there is provided a tube having a grooved inner surface comprising spiral groove fabricating zones formed with spiral grooves at an inner surface of a metal or an alloy tube, intersecting groove fabricating zones arranged at regions different from regions of the spiral groove fabricating zones at the inner surface of the metal or the alloy tube and formed with intersecting groove groups intersected with pluralities of grooves, wherein singles or pluralities of the spiral groove fabricating zones and the intersecting groove fabricating zones are arranged alternately in an inner peripheral direction of the metal or the alloy tube and when a fabrication width of the spiral groove fabricating zone in the inner peripheral direction is designated by a notation $W_1$ and a fabrication width of the intersecting groove fabricating zone is designated by a notation $W_2$, a ratio $W_1/W_2$ of $W_1$ to $W_2$ falls in a range of 0.3 through 0.9 or 1.1 through 3.0.

According to the present invention, in the case in which the tube having the grooved inner surface according to the present invention is used for an evaporator, when a refrigerant liquid is supplied to inside of the tube having the grooved inner surface, since the intersecting groove groups intersected with the plurality of groove groups to each other are formed in the intersecting group fabricating zones, intersecting groove portions intersected with the respective grooves constitute boiling nuclei, evaporation of the refrigerant liquid is expedited and therefore, the evaporating performance can be promoted.

In the meantime, when the tube having the grooved inner surface is used for a condenser, when the refrigerant gas is supplied to inside of the tube having the grooved inner surface, the refrigerant gas is brought into contact with a heat exchanger surface and cooled to condense. The condensed refrigerating liquid is going to produce a swirl flow along the groove groups formed in regions having a wider fabrication width, since the inertia of flow of the condensed liquid of the refrigerant gas at an initial stage of liquefaction is small, the flow of the swirl flow is restrained by the spiral groove groups formed in regions having a narrower width and inclined in the reverse direction. Therefore, the condensed liquid of the refrigerant gas is liable to collect to the lower portion of the tube having the grooved inner surface by the gravitational force, the total of the heat exchanger surface is not covered by the condensed liquid of the refrigerant gas and at the upper portion in the tube having the grooved inner surface, the heat exchanger surface is always brought into contact with the refrigerant gas, continuous condensation is maintained and accordingly, high condensing performance can be achieved.

Further, when $W_1/W_2$ is less than 0.3, the flow of the swirl flow of the refrigerant is expedited and the evaporating performance is promoted, however, the condensed liquid produced by condensing the refrigerant gas is liable to spread over the entire heat exchanger surface and covers the heat exchanger surface and therefore, contact between the heat exchanger surface and the refrigerant gas is hindered and therefore, the condensing performance is deteriorated. In the meantime, when the $W_1/W_2$ exceeds 0.9 and is equal to or lower than 1.0, although the condensing performance is promoted, the evaporating performance is lowered since the swirl flow of the refrigerant is restrained by the spiral groove groups of the spiral groove fabricating zones.

Further, when $W_1/W_2$ is less than 1.1, although the condensing performance is promoted, the effect of restraining the swirl flow of the refrigerant by the intersecting groove portions of the narrow intersecting groove fabricating zones is increased and the evaporating performance is lowered. In the meantime, when $W_1/W_2$ exceeds 3.0, although the swirl flow of the refrigerant is expedited and the evaporating performance is promoted, the condensed liquid liquefied in condensation is liable to spread over the entire heat exchanger surface of the tube having the grooved inner surface, the condensed liquid covers the exchanger surface of the tube having the grooved inner surface, contact between the refrigerant gas and the heat exchanger surface is hindered and the condensing performance is deteriorated. Accordingly, by setting $W_1/W_2$ to fall in a range of 0.3 through 0.9 or setting $W_1/W_2$ to fall in a range of 1.1 through 3.0, high performance can be achieved in both of the evaporating performance and the condensing performance.

Further, it is preferable that a twist direction relative it to a tube axis of the metal or the alloy tube of one groove group in the intersecting groove groups formed in the intersecting groove fabricating zones, is formed in a direction reverse to a direction of the spiral grooves and a groove bottom width of the one groove group is formed wider than a groove bottom width of the other intersecting groove groups. In this case, the one groove group can be formed such that a groove bottom thereof is continuous in the longitudinal direction and a groove bottom of the other groove group is intermittent in the longitudinal direction. In this way, by making continuity of the one groove group stronger than that of the other groove group, the refrigerant liquid produces the swirl flow along the one groove group having the continuity stronger than that of the other groove group and is spread over the entire inner surface of the tube. Accordingly, the evaporating performance of the tube having the inner surface groove can further be promoted.

A fabrication method of a tube having a grooved inner surface according to the present invention is featured in that a surface of a strip-like streak member comprising a metal or an alloy is formed, by rolling, with the intersecting groove fabricating zones and the spiral groove fabricating zones under conditions specified in the above-described aspects of the present invention and butted end portions thereof are welded while rounding the streak member with a surface thereof formed with the intersecting groove fabricating zones and the spiral groove fabricating zones disposed on an inner side.

DETAILED DESCRIPTION OF THE PREFERRED EMBODIMENTS

Figure 1:
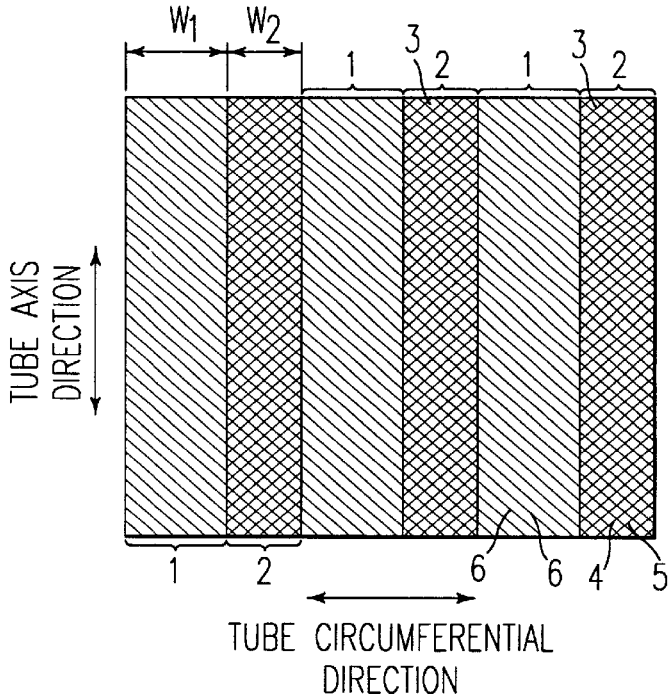
FIG. 1 is a schematic view showing a state in which an inner surface of a tube having a grooved inner surface according to a first embodiment of the present invention is developed in a circumferential direction of the tube.

A specific explanation will be given as follows of tubes having grooved inner surfaces and their production methods according to embodiments of the present invention in reference to the attached drawings. FIG. 1 is a schematic view showing a state in which an inner surface of a tube having a grooved inner surface according to a first embodiment of the present invention is developed in the circumferential direction of the tube.

According to the tube having a grooved inner surface of the embodiment, there are arranged spiral groove fabricating zones 1 formed with spiral groove groups 6 continuous to the tube axis direction at an inner surface of a metal or an alloy tube. Contiguous to the spiral groove fabricating zones 1, there are arranged intersecting groove fabricating zones 2 formed with intersecting groove groups intersected with a plurality of groove groups 3 comprising grooves continuous to the tube axis direction. That is, there are alternately arranged respective threes of the spiral groove fabricating zones 1 and the intersecting groove fabricating zones 2 in the metal or the alloy tube. Further, fabrication widths of the spiral groove fabricating zone 1 and the intersecting groove fabricating zone 2 in the tube circumferential direction are respectively designated by notations $W_1$ and $W_2$ and $W_1$ is larger than $W_2$.

The tube having the grooved inner surface having such a groove shape can be produced by transcribing the groove shape on the surface of one side of a strip-like streak member comprising a metal or an alloy by rolling such that the spiral groove fabricating zones 1 having the fabrication width $W_1$ and the intersecting groove fabricating zones 2 having the fabrication width $W_2$ are alternately arranged as shown by FIG. 1, bending the streak member in a tubular shape with a surface of the streak member for forming the grooves disposed on an inner side and jointing butted end portions thereof by welding while rounding the streak member in the tube circumferential direction.

Next, an explanation will be given of the operation of the tube having the grooved inner surface with the above-described constitution. When the tube having the grooved inner surface is used as an evaporator, firstly, the refrigerant liquid is supplied to inside of the tube having the grooved inner surface. When groove fabricating zones having different fabrication widths in the tube circumferential direction continuous to the tube axis direction are provided at inside of the tube having the grooved inner surface, and grooves having shapes respectively different from each other are arranged, the refrigerant liquid is liable to flow along the grooves of the spiral groove fabricating zones 1 having the wider fabrication width of $W_1$ in the tube circumferential direction. Therefore, a swirl flow of the refrigerant is produced in the tube having the grooved inner surface by forming the spiral grooves at the spiral groove fabricating zones 1 having the wider fabrication width of $W_1$ in the tube circumferential direction. Accordingly, the refrigerant liquid is spread over the entire tube having the grooved inner surface such that high evaporating performance can be achieved.

Further, by forming the groove groups 3 intersected with pluralities of the grooves at the intersecting groove fabricating zones 2 having the narrower fabrication width of $W_2$ in the tube circumferential direction, intersecting groove portions 4 of the respective grooves constitute boiling nuclei, evaporation is expedited and the evaporating performance of the tube having the grooved inner surface can be promoted.

In the meantime, although under a condition of a small flow rate of the refrigerant, the flow speed of the refrigerant is retarded and accordingly, the swirl flow of the refrigerant liquid is difficult to produce, at portions of the heat exchanger surface covered with the refrigerant liquid, evaporation of the refrigerant liquid is expedited with the intersecting groove portions 4 of the grooves as boiling nuclei and therefore, even in the region of the small flow rate of the refrigerant, high evaporating performance can be ensured.

In the meantime, when the tube having the grooved inner surface is used for a condenser, the refrigerant gas is supplied to the tube having the grooved inner surface. The refrigerant gas is brought into contact with the heat exchanger surface and cooled to condense (liquefy). The condensed refrigerant liquid is going to produce a swirl flow along the grooves of the spiral groove fabricating zones 1 having the wider fabrication width of $W_1$, at this occasion, the inertia of flow of the refrigerant liquid is small and therefore, the swirl flow is restrained by the intersecting groove portions 4 formed at the intersecting groove fabricating zones 2 having the narrower fabrication width of $W_2$. Therefore, the condensed refrigerant liquid is liable to condense on the lower surface side of the heat exchanger tube by the gravitational force, the total of the heat exchanger surface is not covered by the condensed refrigerant liquid and on the upper surface side of the heat exchanger tube, the heat exchanger surface is always brought into contact with the refrigerant gas and continuous condensation is maintained. Therefore, high condensing performance can be achieved.

Further, with regard to the respective fabrication widths of the groove forming regions, when $W_1/W_2$ is less than 1.1, although the condensing performance is promoted, the effect of restraining the swirl flow of the refrigerant by the intersecting groove portions 4 of the narrower intersecting groove fabricating zones 2 is increased and the evaporating performance is deteriorated. In the meantime, when $W_1/W_2$ exceeds 3.0, although the swirl flow of the refrigerant is expedited and the evaporating performance is promoted, the condensed liquid liquefied in condensation is liable to spread over the entire heat exchanger surface of the tube having the grooved inner surface, the condensed liquid covers the heat exchanger surface of the tube having the grooved inner surface, contact between the refrigerating gas and the heat exchanger surface is hindered and the condensing performance is deteriorated. Therefore, $W_1/W_2$ is determined to be 1.1 through 3.0.

Although according to the embodiment, there is constructed the constitution in which the intersecting groove fabricating zones 2 formed with the intersecting groove groups intersected with the pluralities of groove groups 3 comprising the grooves continuous to the tube axis direction, are formed, the present invention is not particularly limited thereto but one of the groove groups 3 in the intersecting groove groups formed at the intersecting groove fabricating zones 2, may be twisted relative to the tube axis and the twist may be formed in a direction reverse to that of the spiral grooves formed at the spiral groove fabricating zones 1. Further, according to the one groove group 3, in comparison with other groove group 5 of the intersecting groove fabricating zone 2, a groove bottom width of the groove group 3 in the tube axis section may be formed wider than the groove bottom width of the other groove group 5. Thereby, the refrigerant or the like becomes liable to flow.

Further, although according to the embodiment, there is constructed the constitution in which respective threes of the spiral groove fabricating zones 1 and the intersecting groove fabricating zones 2 are alternately arranged, the present invention is not particularly limited thereto but a single of a plurality thereof may alternately be arranged on the inner surface of the metal or the alloy tube within a range of $W_1/W_2$ of 1.1 through 3.0 with regard to the respective fabrication widths of the spiral groove fabricating zones 1 and the intersecting groove fabricating zones 2.

Figure 2:
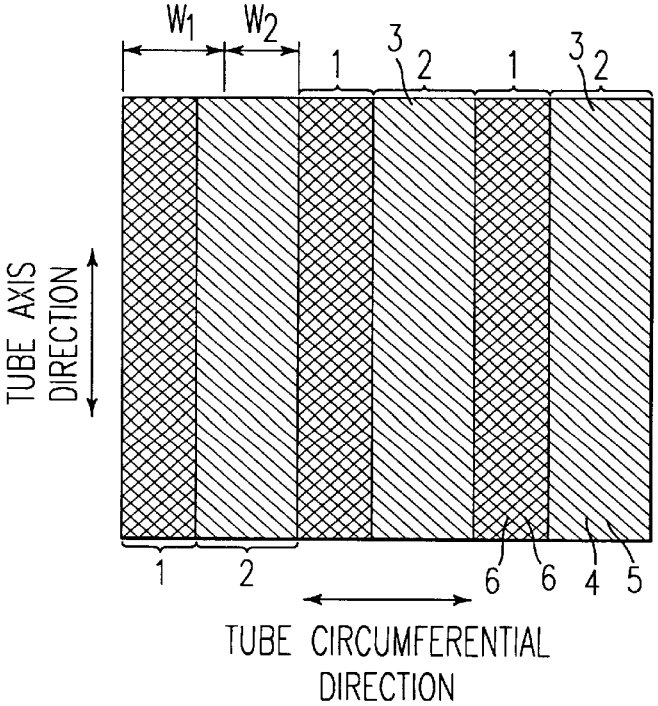
FIG. 2 is a schematic view showing a state in which an inner surface of a tube having a grooved inner surface according to a second embodiment of the present invention is developed in the circumferential direction of the tube.
Figure 3:
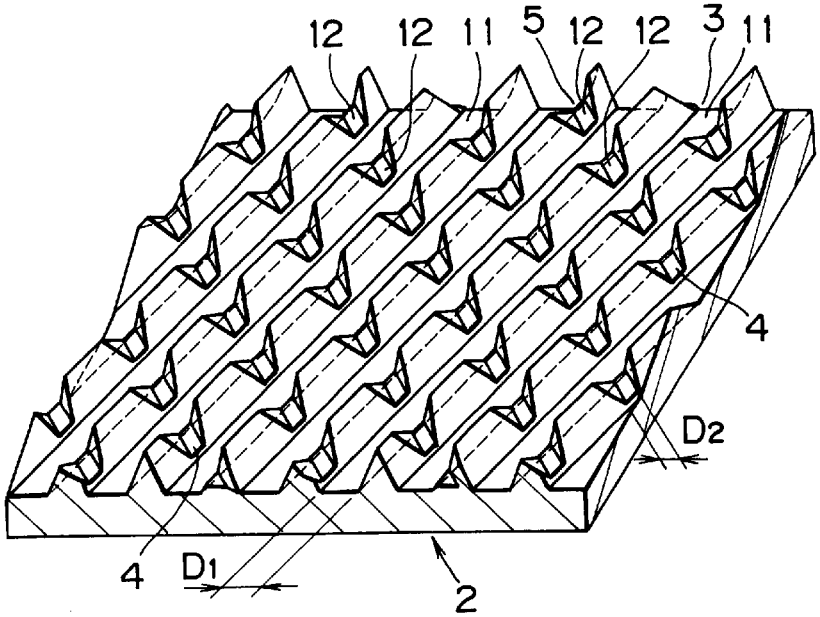
FIG. 3 is a perspective view showing shapes of grooves at the surface of an intersecting groove fabricating zone of FIG. 2.

Next, an explanation will be given of a second embodiment according to the present invention. FIG. 2 is a schematic view showing a state in which an inner surface of a tube having a grooved inner surface according to the second embodiment of the present invention is developed in the circumferential direction of the tube and FIG. 3 is a perspective view showing shapes of grooves on the surface of the intersecting groove fabricating zone 2 of FIG. 2. Further, in FIG. 2, the same notations are attached to constituents the same as those in the first embodiment shown by FIG. 1 and a detailed explanation thereof will be omitted.

As shown by FIG. 2, according to the tube having a grooved inner surface of the embodiment, respective threes of intersecting groove fabricating zones 2 and the spiral groove fabricating zones 1 are arranged alternately in the circumferential direction of the tube at the inner surface of the metal or the alloy tube. The fabrication zone width $W_2$ of the intersecting groove fabricating zone 2 in the tube circumferential direction is larger than the fabrication width $W_1$ of the spiral groove fabricating zone 1 in the tube circumferential direction.

The spiral groove fabricating zone 1 is formed with the spiral groove group 6 comprising the plurality of spiral grooves extended in a predetermined twist angle relative to the tube axis direction. In the meantime, the intersecting groove fabricating zone 2 is formed with the plurality of groove groups comprising the spiral grooves such that the twist angles relative to the tube axis direction are made to differ from each other to thereby intersect the plurality of groove groups to each other. Among the plurality of groove groups in the intersecting groove fabricating zone 2, the twist direction of the groove group 3 having strong continuity of the groove relative to the tube axis direction is formed in a direction reverse to a direction of twisting the spiral groove group 6 formed in the spiral groove fabricating zone 1.

As shown by FIG. 3, in the intersecting groove fabricating zone 2, the groove groups 3 and 5 comprising the pluralities of grooves extended in the spiral shapes are formed to intersect with each other, among them, in the case of the groove group 3 having the strong continuity, groove bottom surfaces 11 thereof are continuous in the longitudinal direction of the groove and in the case of the groove group 5 having weak continuity, groove bottom surfaces 12 thereof are intermittent in the longitudinal direction of the grooves. Further, a width $D_1$ of the groove bottom of the groove group 3 having the strong continuity is wider than a width $D_2$ of the groove bottom of the groove group 5 having the weak continuity ($D_1>D_2$) and in view of the above-described points, the refrigerant or the like is easier to flow in the groove group 3 than in the groove group 5.

The tube having the grooved inner surface having such a groove shape can be fabricated by transcribing the groove shape on the surface of the one side of the strip-like streak member comprising a metal or an alloy such that the intersecting groove fabricating zones 2 having the fabrication width $W_2$ and the spiral groove fabricating zones 1 having the fabrication width of $W_1$ are alternately arranged as shown by FIG. 2, bending the strip-like streak member with a surface of the streak member for forming the groove shape disposed on the inner side and jointing by welding butted end portions thereof while rounding the streak member in the tube circumferential direction.

When the tube having the grooved inner surface of the embodiment constituted as mentioned above is used for an evaporator, firstly, the refrigerant liquid is supplied to inside of the tube having the grooved inner surface. The inner surface of the tube having the grooved inner surface is alternately arranged with the intersecting groove fabricating zones 2 and the spiral groove fabricating zones 1 formed with groove groups having shapes different from each other in the circumferential direction of the tube, the width of the intersecting groove fabricating zone 2 is wider than the width of the spiral groove fabricating zone 1 and accordingly, the flow of the refrigerant liquid undergoes strongly the influence of the intersecting groove fabricating zone 2.

In this case, one of the groove groups 3 in the plurality of groove groups constituting the intersecting groove fabricating zone 2 is formed to be twisted relative to the tube axis and is formed with strong continuity and accordingly, a swirl flow is produced in the refrigerant liquid along the groove groups 3 and the refrigerant liquid is spread over the entire inner surface of the tube. Accordingly, the evaporating performance of the tube having the grooved inner surface is promoted.

Further, the intersecting groove groups intersected with the pluralities of groove groups are formed in the intersecting groove fabricating zones 2 and accordingly, the intersecting groove portions 4 intersected with the respective grooves constitute boiling nuclei, evaporation of the refrigerant liquid is expedited and accordingly, the evaporating performance of the tube having the grooved inner surface can further be promoted.

In the meantime, under a condition of a small flow rate of the refrigerant, the flow speed of the refrigerant is retarded and accordingly, the swirl flow of the refrigerant liquid is difficult to produce, however, at portions of the heat exchanger surface covered with the refrigerant liquid, evaporation of the refrigerant liquid is expedited with the intersecting groove portions 4 of the grooves as boiling nuclei and accordingly, high evaporating performance can be ensured even in the region of the small flow rate of the refrigerant.

In the meantime, when the tube having the grooved inner surface is used for a condenser, the refrigerant gas is supplied to inside of the tube having the grooved inner surface. The refrigerant gas is brought into contact with the heat exchanger surface and cooled to condense (liquefy). The condensed refrigerant liquid is going to produce the swirl flow along the groove groups 3 formed at the intersecting groove fabricating zones 2 and at this occasion, the inertia of flow of the condensed liquid of the refrigerant gas is small and accordingly, the flow of the swirl flow is restrained by the spiral groove groups 6 formed in the spiral groove fabricating zones 1 and having a twist direction reverse to a twist direction of the groove groups 3 formed in the intersecting groove fabricating zone 1.

Accordingly, the condensed liquid of the refrigerant gas is liable to collect to the lower surface side of the tube having the grooved inner surface by the gravitational force, the entire heat exchanger surface is not covered by the condensed liquid of the refrigerant gas and on the upper surface side of the tube having the grooved inner surface, the heat exchanger surface is always brought into contact with the refrigerant gas and continuous condensation is maintained. Accordingly, high condensing performance can be achieved.

Further, when the ratio of the width $W_2$ of the intersecting groove fabricating zone 2 to the width $W_1$ of the spiral groove fabricating zone 1, that is, $W_1/W_2$ exceeds 0.9 and is equal to or smaller than 1.0, although the condensing performance is promoted, the evaporating performance is deteriorated by restraining the swirl flow of the refrigerant by the spiral groove group 6 of the spiral groove fabricating zone 1.

In the meantime, when $W_1/W_2$ is less than 0.3, the flow of the swirl flow of the refrigerant is expedited and accordingly, the evaporating performance is promoted, however, the condensed liquid produced by condensing the refrigerant gas is liable to spread over the entire heat exchanger surface and covers the heat exchanger surface to thereby hinder contact between the heat exchanger surface and the refrigerant gas and accordingly, the condensing performance is deteriorated.

Therefore, in order to achieve high performance both in the evaporating and the condensing, $W_1/W_2$ falls in a range of 0.3 through 0.9.

Further, when there are formed two kinds of groove groups having twists in directions reverse to each other relative to the tube axis and formed with wide groove bottom widths, the pressure loss is increased and accordingly, it is preferable to make the respective twist angles different from each other.

Further, although according to the embodiment, there is constructed the constitution in which respective threes of the intersecting groove fabricating zones 2 and the spiral groove fabricating zones 1 are arranged alternately, the present invention is not particularly limited thereto but a single or a plurality thereof may alternately be arranged on the inner surface of a metal or an alloy tube within a range of $W_1/W_2$ of 0.3 through 0.9 with regard to the respective fabrication widths of the intersecting groove fabricating zone 2 and the spiral groove fabricating zone 1.

EXAMPLES

A specific explanation will be given as follows of a result in which a tube having a grooved inner surface according to an example of the present invention is produced and its properties are compared with those of a tube having a grooved inner surface of a comparative example.

As a material for the tubes having grooved inner surfaces according to the example and the comparative example, there is used a strip-like streak member slitted to a predetermined width by a coil of phosphorous deoxidized copper (JIS H3100 C1220) having a thickness of 0.45 mm. Grooving of the streak member is carried out by passing the streak member through a rolling mill arranged with a groove forming roll having a predetermined shape on the upper side to thereby transcribe a recess and projection shape of the upper roll onto the streak member. In order to form the spiral grooves and the intersecting grooves of the present invention on the same streak member, there may be used a tandem-type rolling mill having two stands of rolling mills in one line. Further, in the case of using a rolling apparatus having only one set of rolls, for example, the spiral grooves are initially formed by rolling to thereby finish with the rolling, thereafter, in a second time of rolling which is carried out by exchanging the upper roll, the spiral grooves in the direction reverse to that in the first time are formed to thereby form the intersecting grooves at predetermined positions. According to the example and the comparative example, the streak member having the grooves is produced by using a tandem rolling mill continuously arrayed with two stands of rolling mills.

In this way, the tandem rolling mill continuously arrayed with two stands of the rolling mills is used and at the first stand rolling mill, primary groove groups having a groove depth of 0.2 mm, a groove pitch of 0.41 mm in the circumferential direction of the tube and a twist angle of a right-handed screw direction relative to the tube axis of 15°, are formed by rolling over an entire one-sided surface while leaving both end portions of the streak member respectively by 1 mm. Further, an apex angle of a fin (projected portion) is set to 25° and a wall thickness at a groove bottom (minimum wall thickness) is set to 0.25 mm.

The streak member rolled with the grooves by the first stand rolling mill is successively conducted to the second stand rolling mill and secondary groove groups having a groove depth of 0.2 mm, a groove pitch in the circumferential direction of the tube of 0.41 mm and a twist angle in a left-handed screw direction relative to the tube axis of 30° (the twist angle and the twist direction differ from those of the primary groove groups), are formed by rolling with predetermined fabrication widths spaced apart from each other by predetermined intervals at three locations in the plate thickness direction (corresponding to the circumferential direction of the tube). Further, at portions which are not reduced by the secondary rolling, the grooves in the primary rolling remain as they are. That is, there is provided a copper plate with grooves alternately arranged with the spiral groove fabricating zones by the primary rolling and the intersecting groove fabricating zones by the secondary rolling in the plate width direction. Further, in the second stand rolling mill, by setting up groove forming upper rolls having different widths, the ratio of the fabrication width of the spiral groove fabricating zone to the fabrication width of the intersecting groove fabricating zone is changed.

In this way, a tube with a grooved inner surface having an outer diameter of 7.0 mm is formed by sizing the tube diameter by butting together end portions of the plate width while rounding the streak member with the groove fabricating surface of the streak member fabricated with the grooves disposed on the inner side and while subjecting the end portions to high frequency welding.

The tube having the grooved inner surface formed in this way is arranged on the inner side of a double tube type heat exchanger (hereinafter, referred to as outer tube) having the length of 3000 mm, a refrigerant (R-410A) is supplied to inside of the tube having the grooved inner surface, water is supplied to a ring-like portion between the tube having the grooved inner surface and the outer tube to thereby carry out heat exchange and the heat exchanger performance is measured.

Further, as a reference member for comparing the heat exchanger performance with the embodiment, there is produced a tube having a grooved inner surface with an outer diameter of 7.0 mm formed with only spiral groove groups (groove depth: 0.2 mm, groove pitch in the circumferential direction of the tube: 0.41 mm, a twist angle relative to the tube axis: 18° (right-handed screw direction), fin apex angle: 20°, groove bottom wall thickness: 0.25 mm), the heat exchanger performance is measured and performances of the tubes having the grooved inner surfaces according to the example and the comparative example are represented by ratios as compared with the heat exchanger performance of the reference member as follows.

Figure 4:
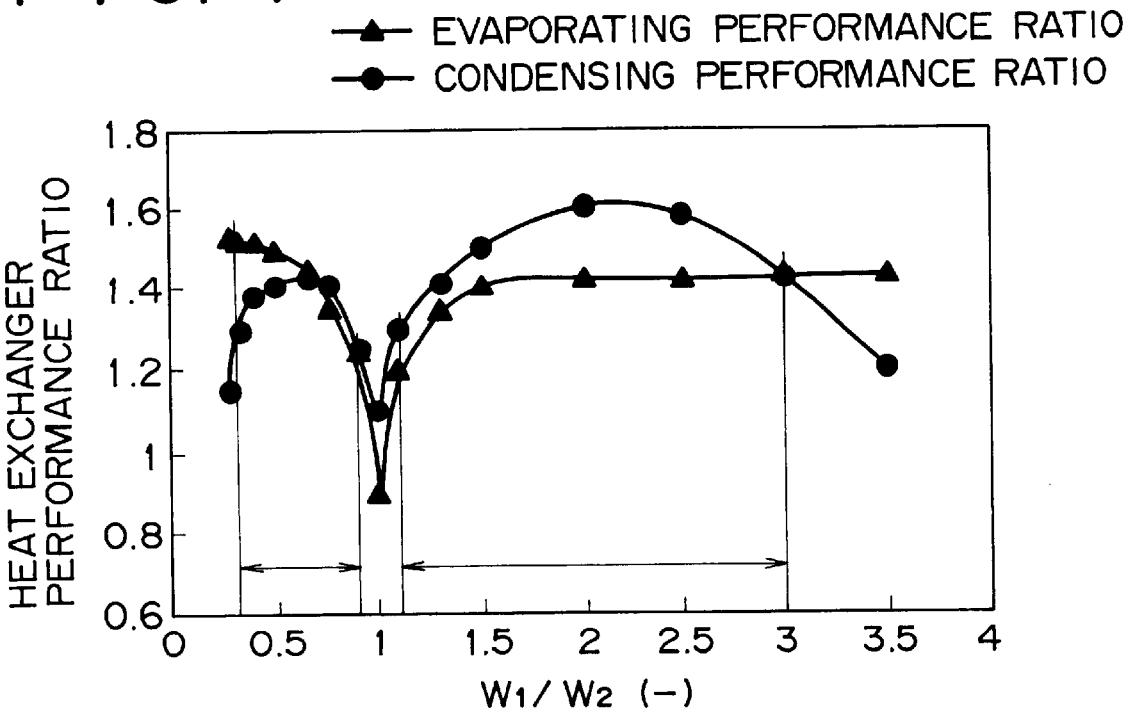
FIG. 4 is a graph diagram showing a relationship between a ratio ($W_1/W_2$) and a heat exchanger performance ratio by taking the heat exchanger performance ratio on the ordinate and the ratio ($W_1/W_2$) of a fabrication width ($W_1$) of the intersecting groove fabricating zone formed with intersecting groove groups to a fabrication width ($W_2$) of a spiral groove fabricating zone formed with a spiral groove group on the abscissa.

FIG. 4 is a graph diagram showing a relationship between the ratio ($W_1/W_2$) and the heat exchanger performance ratio by taking the heat exchanger performance ratio on the ordinate and the ratio ($W_1/W_2$) of the fabrication width ($W_1$)

of the intersecting groove fabricating zone formed with the intersecting groove groups to the fabrication width ($W_2$) of the spiral groove fabricating zone formed with the spiral groove groups on the abscissa. Marks ▲ in the drawing indicate evaporation performance ratios and marks ● indicate condensing performance ratios.

Table 1, shown below, and FIG. 4 show the ratio of the heat exchanger performance of the tube having the grooved inner surface according to the example to the heat exchanger performance of the tube having the inner surface groove according to the reference member (evaporating performance ratio and condensing performance ratio) in the case of the flow rate of the refrigerant of 20 kg/h.

TABLE 1

| | No. | $W_1/W_2$ | Evaporating performance ratio | Condensing performance ratio |
|---|---|---|---|---|
| EXAMPLE | 1 | 0.33 | 1.52 | 1.3 |
| | 2 | 0.4 | 1.52 | 1.38 |
| | 3 | 0.5 | 1.5 | 1.4 |
| | 4 | 0.67 | 1.45 | 1.42 |
| | 5 | 0.77 | 1.36 | 1.4 |
| | 6 | 1.1 | 1.2 | 1.3 |
| | 7 | 1.3 | 1.35 | 1.4 |
| | 8 | 1.5 | 1.41 | 1.5 |
| | 9 | 2 | 1.42 | 1.6 |
| | 10 | 2.5 | 1.43 | 1.58 |
| | 11 | 3 | 1.44 | 1.42 |
| COMPARATIVE EXAMPLE | 12 | 0.29 | 1.53 | 1.15 |
| | 13 | 0.91 | 1.25 | 1.25 |
| | 14 | 1 | 0.9 | 1.1 |
| | 15 | 3.5 | 1.44 | 1.2 |

As shown by Table 1 and FIG. 4, when $W_1/W_2$ is 1, there is provide the heat exchanger performance equivalent to that of the reference member. As $W_1/W_2$ becomes larger or smaller than 1, the heat exchanger performance (evaporating performance and condensing performance) is rapidly increased and in regions of $W_1/W_2$ of 0.3 through 0.9 and $W_1/W_2$ of 1.1 through 3.0, the heat exchanger performance is significantly improved by 20% or more compared with that of the reference member. Further, in a region in which $W_1/W_2$ is less than 0.3, the condensing performance is lowered and in a region in which $W_1/W_2$ exceeds 3.0, the evaporating performance is lowered. Further, in a region of $_1/W_2$ of 0.3 through 0.9, the evaporating performance is particularly excellent and meanwhile, in a region of $W_1/W_2$ of 1.1 through 3.0, the condensing performance is particularly excellent.

As has been described in details, according to the present invention, since $W_1/W_2$ falls in a range of 0.3 through 0.9 or 1.1 through 3.0, both of the evaporating performance and the condensed performance are excellent, by using the tube having the grooved inner surface according to the present invention, even in the case of a small flow rate of the refrigerant, the performance of a heat exchanger becomes extremely excellent and an energy conversation effect of an air conditioner or the like is promoted significantly. Further, the performance of a heat exchanger can further be promoted by using a heat exchanger tube having an excellent evaporating performance ratio in a range of 0.3 through 0.9 of $W_1/W_2$ for a heat exchanger in which importance is particularly attached to a household cooling performance and using a heat exchanger tube having an excellent condensing performance ratio of in a range of 1.1 through 3.0 of $W_1/W_2$ in a heat exchanger in which importance is particularly attached to a household heating performance.

What is claimed is:

1. A tube having a grooved inner surface comprising:

spiral groove fabricating zones formed with spiral grooves at an inner surface of a metal or an alloy tube;

intersecting groove fabricating zones arranged at regions different from regions of the spiral groove fabricating zones at the inner surface of the metal or the alloy tube and formed with intersecting groove groups intersected with pluralities of grooves;

wherein singles or pluralities of the spiral groove fabricating zones and the intersecting groove fabricating zones are arranged alternately in an inner peripheral direction of the metal or the alloy tube and when a fabrication width of the spiral groove fabricating zone in the inner peripheral direction is designated by a notation $W_1$ and a fabrication width of the intersecting groove fabricating zone is designated by a notation $W_2$, a ratio $W_1/W_2$ of $W_1$ to $W_2$ falls in a range of 0.3 through 0.9 or 1.1 through 3.0, wherein a twist direction relative to a tube axis of the metal or the alloy tube of one groove group in the intersecting groove groups formed in the intersecting groove fabricating zones, is formed in a direction reverse to a direction of the spiral grooves and a groove bottom width of the one groove group is formed wider than other groove bottom width of the intersecting groove groups.

2. The tube having an inner surface according to claim 1:

wherein a groove bottom of the one groove group is formed continuously in a longitudinal direction and a groove bottom of the other groove groups are formed intermittently in the longitudinal direction.

3. A method of fabricating a tube having a grooved inner surface in a method of fabricating the tube having a grooved inner surface according to claim 1, said method comprising the steps of:

forming the intersecting groove fabricating zones and the spiral groove fabricating zones by rolling on a surface of a strip-like streak member comprising a metal or an alloy; and welding butted end portions of the streak member while rounding the streak member with a surface thereof formed with the intersecting groove fabricating zones and the spiral groove fabricating zones disposed on an inner side.

4. A method of fabricating a tube having a grooved inner surface in a method of fabricating the tube having a grooved inner surface according to claim 2, said method comprising the steps of:

forming the intersecting groove fabricating zones and the spiral groove fabricating zones by rolling on a surface of a strip-like streak member comprising a metal or an alloy; and welding butted end portions of the streak member while rounding the streak member with a surface thereof formed with the intersecting groove fabricating zones and the spiral groove fabricating zones disposed on an inner side.

* * * * *